US007163195B2

(12) United States Patent
Lawson

(10) Patent No.: US 7,163,195 B2
(45) Date of Patent: Jan. 16, 2007

(54) DISPLACED FORCE BACKING WEDGE

(75) Inventor: Jeffrey G. Lawson, 229 Willow Ave., South San Francisco, CA (US) 94080

(73) Assignee: Jeffrey G. Lawson, South San Francisco, CA (US)

( * ) Notice: Subject to any disclaimer, the term of this patent is extended or adjusted under 35 U.S.C. 154(b) by 98 days.

(21) Appl. No.: 10/937,820

(22) Filed: Sep. 10, 2004

(65) Prior Publication Data

US 2006/0054873 A1 Mar. 16, 2006

(51) Int. Cl.
*B66F 13/00* (2006.01)

(52) U.S. Cl. ..... 254/1; 254/28; 254/120

(58) Field of Classification Search ..... 254/DIG. 1, 254/131, 120, 21, 25, 26 E, 26 R, 28
See application file for complete search history.

(56) References Cited

U.S. PATENT DOCUMENTS

| | | | | |
|---|---|---|---|---|
| 1,556,584 | A * | 10/1925 | Breeden | 254/104 |
| 2,239,719 | A * | 4/1941 | Jarrett | 254/26 R |
| 2,379,387 | A * | 6/1945 | Tessier | 254/131 |
| 4,130,270 | A * | 12/1978 | Andersson | 254/104 |
| 2005/0161647 | A1 * | 7/2005 | Buch et al. | 254/28 |

* cited by examiner

*Primary Examiner*—Lee D. Wilson
(74) *Attorney, Agent, or Firm*—Jeffrey G. Lawson

(57) ABSTRACT

Displaced force backing wedge with a rigid wedge shape, a rigid handle, the wedge shape having a plurality of rounded ridges extending from left to right at its top most surface. The wedge shape has a centrally located slot extending perpendicularly from the thin edge of the wedge to the center area of the wedge. The handle extends outward perpendicularly from a central portion of the thick side of the wedge. A preferred embodiment includes rounded ridges that run parallel to the front surface and start as a small radius and progress to larger radius.

1 Claim, 3 Drawing Sheets

DISPLACED FORCE BACKING WEDGE

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of carpenter tools and more specifically to a displaced force backing wedge.

Often during the process of building or reconstructing a home, office or other structure it becomes necessary to pry loose and remove a nail or trim board or other building materials with a crow bar, claw hammer or other removal tools. Unfortunately, during the process, the surrounding wall surface such as sheet rock or relatively soft wood can become marred by the removal tool because the opposing force exerted by the underside of the removal tool is located in a relatively small area and can thereby cause dents or marring. This causes extra work for the user because the dents or mars have to be filled and refinished.

During typical construction or demolition a putty knife, wall board spatula, piece of wood or the like is used to displace and spread the force of a crowbar during the prying process.

Unfortunately, these items were not designed specifically for the intended use and therefore do not always work well. For example, using a putty knife under a crow bar or hammer claw may be too thin and not give enough leverage for the extraction or loosening process. When using a piece of wood, the user must find the proper thickness of wood, and there is always the danger of not spreading the force enough so that a dent or mar is still a possibility. Additionally, a spatula or piece of wood is generally a flat surface and does not give lateral stability to the crow bar or claw hammer during use.

BRIEF SUMMARY OF THE INVENTION

The primary object of the invention is to provide a hand held wedge shaped protective device that displaces the weight and force of a crow bar or claw portion of a hammer across a broader surface area when prying a nail or trim board or other item from a finished surface.

Another object of the invention is to provide a hand held wedge shaped protective device that can allow the user to increase or decrease the height of leverage needed when loosening a nail or trim board or the like.

Another object of the invention is to provide a hand held wedge shaped protective device that improves stabilization of a crow bar or hammer while in use for prying.

A further object of the invention is to provide a hand held wedge shaped protective device that is easy and convenient for the user to hold during use.

Yet another object of the invention is to provide a hand held wedge shaped protective device that can be used for protecting a finished surface while in the act of hammering in a nail.

A further use of the invention is to aid in the removal of screws by providing an outwardly biased force while unscrewing using conventional means.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a displaced force backing wedge comprising: a rigid wedge shape, a rigid handle, said wedge shape having a plurality of rounded ridges extending from left to right at its top most surface, said wedge shape having a centrally located slot extending perpendicularly from the thin edge of said wedge to the center area of said wedge, and said handle extending outward perpendicularly from a central portion of the thick side of said wedge.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
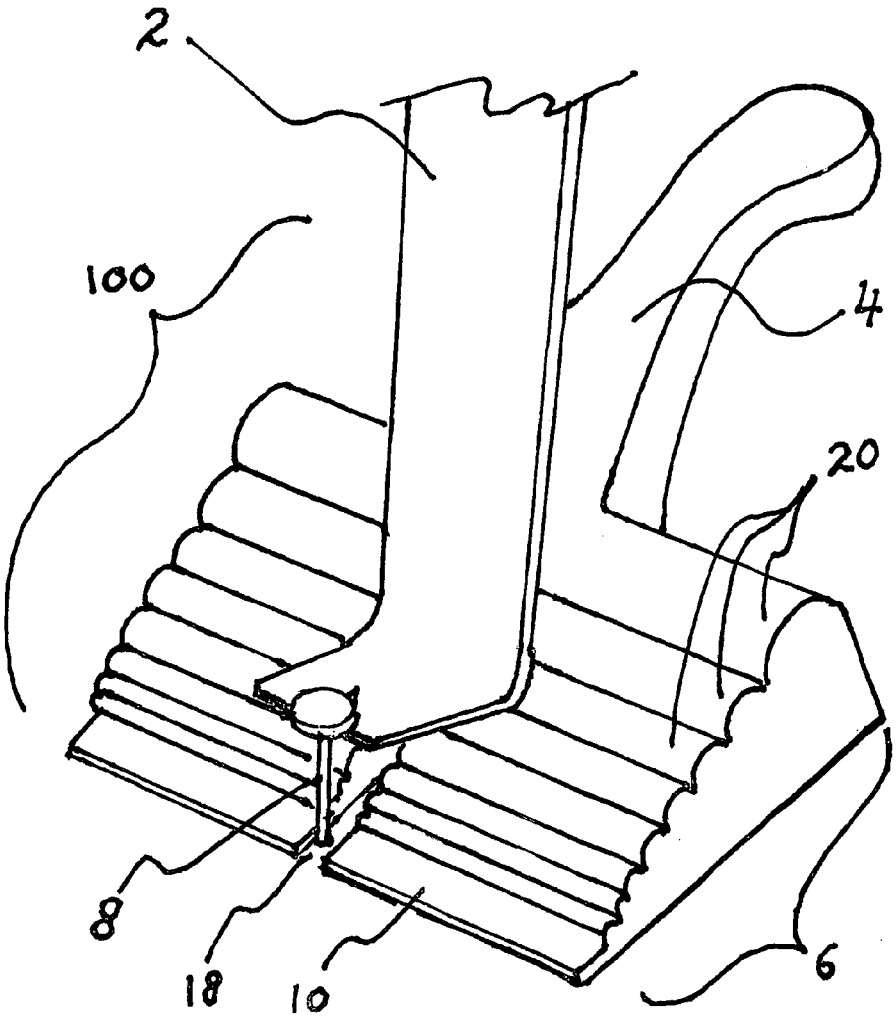
FIG. 1 is a perspective view of the invention.

Referring now to FIG. 1 we see a perspective view of the invention 100. The invention is comprised of a wedge shape 6 and an attached handle 4. The wedge shape has a slot 18 extending from the front portion of the wedge to the center of the wedge. The top surface of the wedge includes rounded ridges 20 that can help stabilize a nail removal tool such as a pry bar 2 or crow bar or claw portion of a hammer. The wedge shape 6 and slot 18 allows the user to position the pry bar 2 at the ideal height for a given circumstance such as removing a nail 8 as shown. I will now provide three examples of the use of the present invention. During a bathroom remodel, moldings need to be removed from the base and crown of a room. The present invention acts as a backing that prevents damage to sheet rock by displacing the force applied to the wall board while prying. A second example is that of a large nail protruding three inches from sheet rock or other construction. The nail is situated in a wooden stud. In order to pry out the nail using a common hammer, crow bar or pry bar one would need a sizable block of wood to act as a point of leverage and to displace the force. The present invention eliminates the need to use different shapes and sizes of wood to act as a pivoting point.

Figure 2:
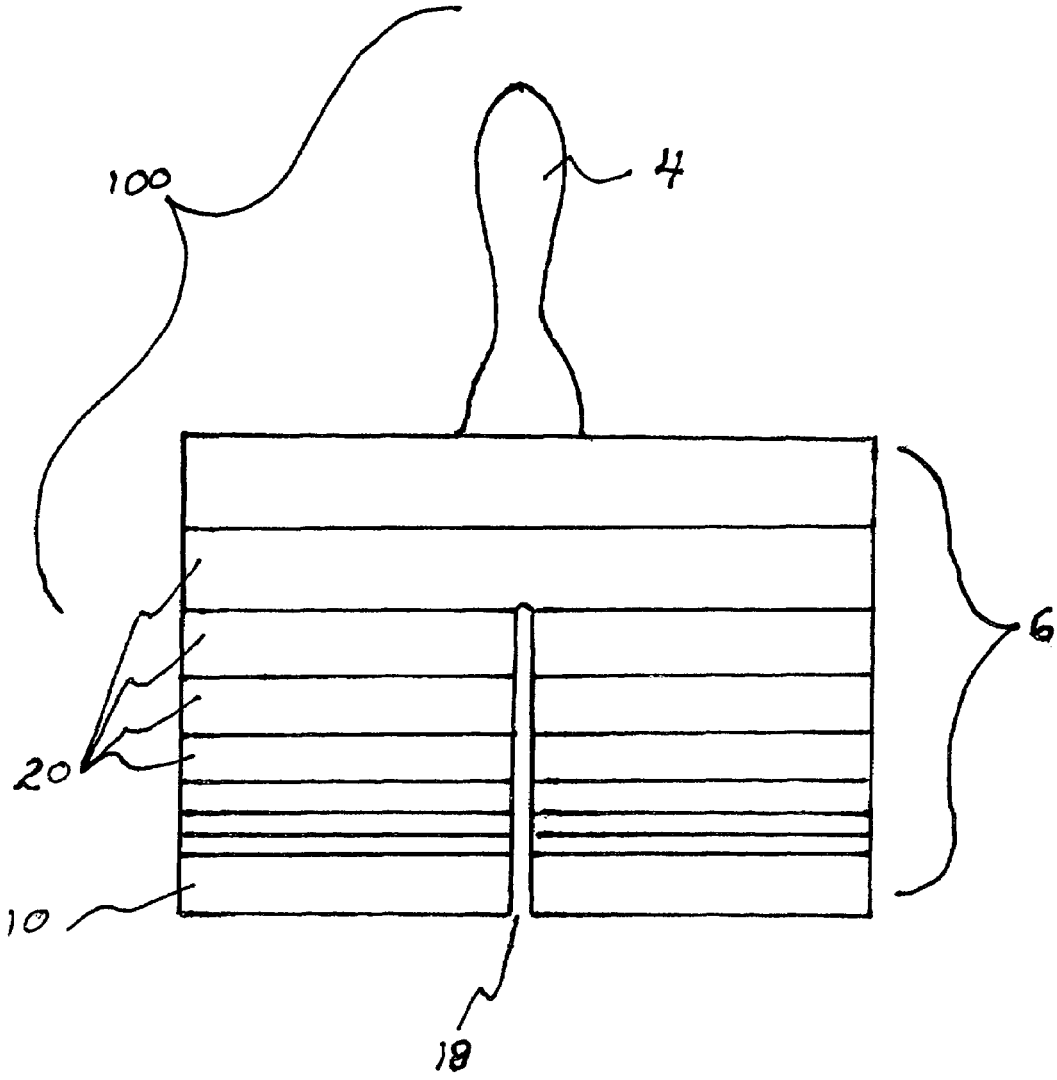
FIG. 2 is a top view of the invention.
Figure 3:
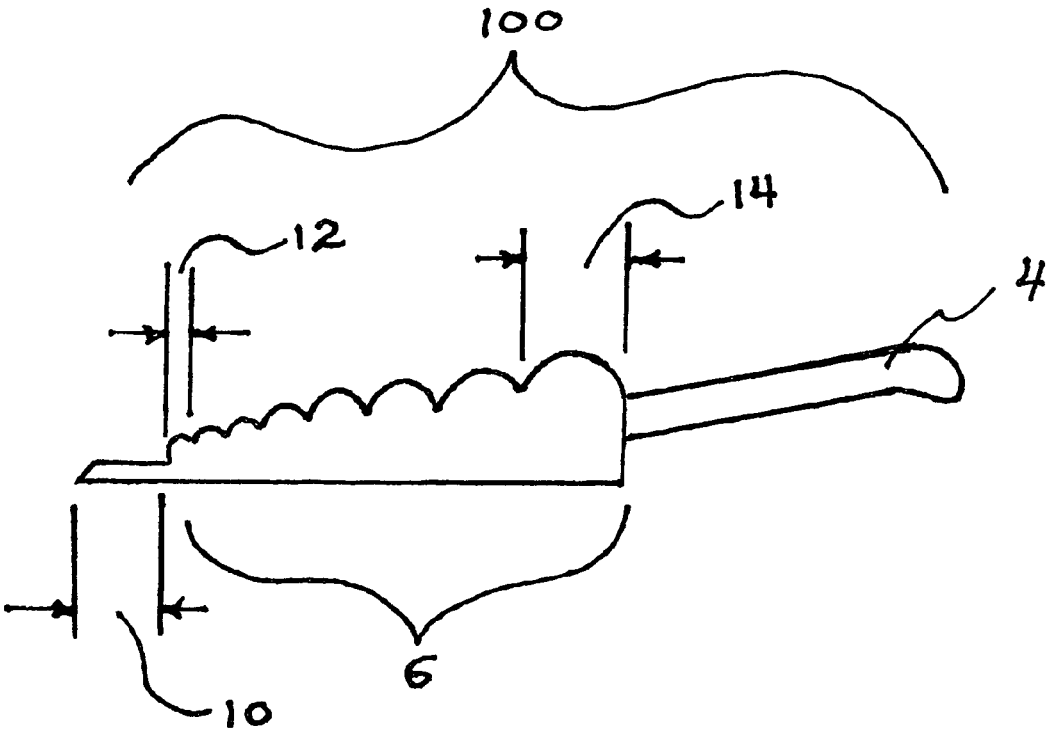
FIG. 3 is a side view of the invention.

A third example is that of a large screw embedded in sheet rock but not screwed into a stud. In order to remove the screw without damaging the wall, one would need to pull it up with pliers and hold it while trying to unscrew it with a screw-driver or the like. The present invention 100 can help remove the screw by flipping the wedge over, inserting the screw head into slot 18 and using the largest of the graduated ridges 20 as a pivot point. The user can push down on the handle 4 and because of the outward biased pressure, assist the screw out of the sheet rock. A further use for the invention 100 is to provide a protective shield when hammering in a nail. In this case, the user slides the nail into slot 18 so that the nail is located at the flat front portion 10 of the wedge 6. When the user hammers in the nail, any errant strikes will hit the surface 10 and not the wall or other finished surface. The user would remove the device 100 for the final tapping of the nail into the wall. FIG. 2 is a top view of the invention 100. FIG. 3 is a side view of the invention 100. The graduated ridges increase in one eighth of an inch increments from one quarter of an inch 12 at the front of the wedge 6 to one inch 14 at the rear.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A displaced force backing wedge comprising:

a rigid wedge having a wedge shape that includes a thin front side and a thick rear side;

and a rigid handle;

said wedge having a plurality of rounded ridges extending from the left side of said wedge to the right side of said wedge at top most surface;

said wedge having a centrally located slot extending perpendicularly from the front most thin edge of said wedge to a central mid point of said wedge;

said handle fixedly and centrally attached to the rear side of said rigid wedge so that said handle extends outwardly parallel to and at right angles to the top surface of said wedge;

said rounded ridges start as a small radius approximately one eighth of an inch and progress incrementally to a large radius of approximately one half of one inch;

said front most thin portion of said wedge remaining relatively flat extending from said wedge for approximately one inch so as to act as a shield for stray hammer blows.

* * * * *